US005300958A

United States Patent [19]

Burke et al.

[11] Patent Number: 5,300,958

[45] Date of Patent: Apr. 5, 1994

[54] METHOD AND APPARATUS FOR AUTOMATICALLY CLEANING THE PRINTHEAD OF A THERMAL INKJET CARTRIDGE

[75] Inventors: Peter M. Burke; Earl L. Barton, both of Corvallis, Oreg.

[73] Assignee: Hewlett-Packard Company, Palo Alto, Calif.

[21] Appl. No.: 843,499

[22] Filed: Feb. 28, 1992

[51] Int. Cl.[5] ..... B41J 2/165

[52] U.S. Cl. ..... 346/140 R; 346/1.1

[58] Field of Search ..... 346/140 R, 1.1

[56] References Cited

U.S. PATENT DOCUMENTS

| | | | |
|---|---|---|---|
| 4,500,895 | 2/1985 | Buck et al. | 346/140 R |
| 4,719,477 | 1/1988 | Hess | 346/140 R |
| 4,794,409 | 12/1988 | Cowger et al. | 346/140 R |
| 4,853,717 | 8/1989 | Harmon et al. | 346/140 R |
| 5,027,134 | 6/1991 | Harmon et al. | 346/140 R |
| 5,182,582 | 1/1993 | Okamura | 346/140 R |

FOREIGN PATENT DOCUMENTS

| | | | |
|---|---|---|---|
| 0335699 | 4/1989 | European Pat. Off. | B41J 3/04 |
| 3817754 | 11/1989 | Fed. Rep. of Germany . | |
| 4000454 | 11/1991 | Fed. Rep. of Germany . | |
| 62-101448 | 5/1987 | Japan . | |
| 62-196153 | 8/1987 | Japan . | |
| 62-226212 | 3/1989 | Japan . | |
| 3-215043 | 9/1991 | Japan | B41J 2/165 |

OTHER PUBLICATIONS

*Hewlett-Packard Journal,* vol. 36, No. 5 (May 1985).

*Hewlett-Packard Journal,* vol. 39, No. 4 (Aug. 1988).

*Primary Examiner*—Benjamin R. Fuller

*Assistant Examiner*—David Yockey

[57] ABSTRACT

An automatic system for cleaning a thermal inkjet printhead. A thermal inkjet cartridge and service station are provided within a printer unit. The service station is directly beneath the cartridge when it is not printing. Attached to the service station is a printhead wiper unit consisting of a single member or, in the alternative, dual members positioned against each other to form a capillary pathway therebetween. The cartridge includes a compartment having an opening therethrough and an absorbent member impregnated with cleaning solution When the cartridge is not printing, the wiper unit is aligned with the compartment containing the absorbent member and is in contact therewith. This supplies the wiper unit with cleaning solution The service station may include a secondary absorbent member contacting with the wiper unit to absorb cleaning solution from the capillary pathway in a dual wiper system or supply the pathway with additional solution

30 Claims, 6 Drawing Sheets

METHOD AND APPARATUS FOR AUTOMATICALLY CLEANING THE PRINTHEAD OF A THERMAL INKJET CARTRIDGE

BACKGROUND OF THE INVENTION

The present invention generally relates to thermal inkjet printing systems, and more particularly to a thermal inkjet cartridge system having means therein for automatically applying a printhead cleaning solution to the cartridge printhead.

Substantial developments have been made in the field of electronic printing technology. Specifically, a wide variety of highly efficient printing systems currently exist which are capable of dispensing ink in a rapid and accurate manner. Thermal inkjet systems are especially popular in this regard. Thermal inkjet systems basically include an ink reservoir in fluid communication with a substrate having a plurality of resistors thereon Selective activation of the resistors causes thermal excitation of the ink and expulsion thereof from the ink cartridge. Representative thermal inkjet systems are discussed in U.S. Pat. No. 4,500,895 to Buck et al.; U.S. Pat. No. 4,794,409 to Cowger et al.; the *Hewlett-Packard Journal,* Vol. 36, No. 5 (May 1985); and the *Hewlett-Packard Journal,* Vol. 39, No. 4 (August 1988), all of which are incorporated herein by reference.

In general, thermal inkjet printing cartridges use a variety of functional components, all of which must cooperate in a precise manner to achieve maximum printing efficiency. One important component involves an orifice plate having a plurality of openings therein. Ink is ejected through these openings during cartridge operation. To ensure proper cartridge operation, the orifice plate and openings must be kept clean and free of debris at all times. Otherwise, a wide variety of problems can occur which impair printer performance For example, debris on the orifice plate surface (e.g. from stray paper fibers and the like) can reduce the quality/-resolution of printed images. Similar problems can occur with respect to dried ink which may form crusts on the orifice plate during cartridge operation. Such crusts typically result from evaporation/oxidation of the ink being ejected from the cartridge.

In order minimize the foregoing problems, devices known as "service stations" have been created which are physically mounted to and within the main printer unit. They are specifically oriented within the printer unit so that when the cartridge is not operating and is in a "parked" position, the cartridge is directly over and above the service station Service stations have a variety of components which are designed to serve many purposes These purposes include but are not limited to (a) priming the printhead; (b) covering the orifice plate and openings therein when the printhead is not in operation; (c) wiping contaminants from the orifice plate; (d) preventing ink from drying out in the openings of the orifice plate; and (e) providing a location to eject soft, viscous plugs of ink which may form in the openings of the orifice plate. Specific systems designed to perform some or all of these functions are disclosed in U.S. Pat. No. 4,853,717 and U.S. Pat. No. 5,027,134 which are incorporated herein by reference.

One of the most important functions of a service station is item (c) above which involves wiping contaminants from the orifice plate and openings therein. To accomplish this, U.S. Pat. No. 4,853,717 discloses the use of a resilient elastomeric wiper member having a blade portion which comes in contact with the printhead during operation thereof. More specifically, as the cartridge moves in a reciprocating manner within the printer unit, the blade portion of the wiper member brushes against the printhead to enable the cleaning thereof.

Another type of wiper system is disclosed in German Patent Specification 3,817,754 which apparently involves an external pad soaked with cleaning agents mounted to an external, rotating arm. As the rotating arm moves, the pad positioned on the arm wipes against the printhead components of the cartridge.

Notwithstanding the systems described above, a need remains for a printhead cleaning system of superior efficiency which not only provides a wiping unit, but also allows the controlled delivery of a printhead cleaning solution to the printhead. This enables the wiping unit to more efficiently remove dried ink materials and the like. Accordingly, the present invention satisfies this need in a unique and highly effective manner as described herein below.

SUMMARY OF THE INVENTION

It is an object of the present invention to provide a improved method and apparatus for cleaning a thermal inkjet printhead.

It is another object of the invention to provide a method and apparatus for cleaning a thermal inkjet printhead which is automatic in operation.

It is another object of the invention to provide a method and apparatus for cleaning a thermal inkjet printhead which is substantially self-contained and requires a minimal amount of operating components.

It is a further object of the invention to provide a method and apparatus for cleaning a thermal inkjet printhead which requires a minimal amount of maintenance and user support.

It is a still further object of the invention to provide a method and apparatus for cleaning a thermal inkjet printhead which enables the delivery of a controlled amount of a cleaning solution to the printhead.

It is an even further object of the invention to provide a method and apparatus for cleaning a thermal inkjet printhead which uses a special wiper system in combination with the application of a cleaning solution to effectively clean the printhead.

In accordance with the foregoing objects, the present invention involves a unique and highly effective system for cleaning the printhead (e.g. the orifice plate and openings therein) of a thermal inkjet cartridge during the operation thereof Specifically, a thermal inkjet cartridge is provided which is designed for reciprocating movement within a thermal inkjet printer Also provided is a service station in the form of a platform operatively secured to and within the printer unit. The service station is positioned so that it is directly beneath the cartridge when the cartridge is in a non-operational "parked" position The service station typically includes a resilient cap member designed to receive the printhead of the cartridge when the cartridge is in a parked position The cap member is configured so that it provides a protective barrier surrounding the openings through the orifice plate of the printhead. Also provided on the platform of the service station is an elastomeric wiper unit which, in one embodiment, is substantially planar in configuration with an upper blade portion that extends outwardly from and above the service station platform. The wiper unit is designed to come in contact with the printhead of the cartridge during operation and reciprocating movement thereof.

In order to facilitate cleaning of the printhead by the wiper unit, the cartridge is provided with a compartment having a supply of a printhead cleaning solution therein In a preferred embodiment, the compartment has a primary absorbent member therein which is impregnated with the cleaning solution. The compartment may consist of a separate chamber secured to the exterior surface of the cartridge, or may alternatively be formed as a separate compartment inside the cartridge housing. In either case, the bottom of the compartment will have an opening therein in order to provide access to and enable contact with the primary absorbent member having the cleaning solution therein. The primary absorbent member may be configured so that it is positioned entirely inside the compartment or extends partially outside of the compartment. The wiper unit is positioned on the service station platform so that when the cartridge moves to a parked position, the wiper unit is aligned with the compartment containing the primary absorbent member, and directly contacts the primary absorbent member. As noted above, access to the primary absorbent member is made possible by the opening through the bottom of the compartment. Contact between the primary absorbent member and the wiper unit in the foregoing manner moistens the wiper unit with cleaning solution. The wiper unit is then able to clean the printhead of the cartridge in a substantially more efficient manner once operation of the cartridge resumes In a further embodiment, the wiper unit consists of two separate elastomeric wiper members, each wiper member having an upper section and a lower section The upper section of each wiper member functions as a blade designed to come in contact with the printhead of the cartridge during operation and reciprocating movement thereof. The wiper members are elongate, resilient, and secured to the service station platform so that they are adjacent to and directly against each other. The juncture between the wiper members forms a capillary pathway. The capillary pathway is designed to receive cleaning solution from the primary absorbent member which comes in contact with the wiper members in the manner described above when the cartridge is in a parked position. As a result, cleaning solution is drawn into the capillary pathway where it is temporarily stored therein, making additional amounts of cleaning solution available once printer operation resumes.

In a further alternative embodiment, the service station platform may also include a secondary absorbent member in contact with the lower sections of the wiper members which extend beneath the service station platform. The secondary absorbent member may be housed in a reservoir chamber having an opening therein. The opening enables communication to occur between the lower sections of the wiper members and the secondary absorbent member. In this embodiment, the secondary absorbent member may be positioned entirely within the reservoir chamber or may extend partially outward therefrom. The secondary absorbent member is used to absorb excess cleaning solution from the capillary pathway between the wiper members. This is especially important when the upper sections of the wiper members are in contact with the primary absorbent member of the cartridge for an extended period of time (e.g. during prolonged periods of cartridge non-use). In addition, when cartridge operation resumes, excess cleaning solution collected within the secondary absorbent member may be drawn outwardly therefrom by capillary action into the capillary pathway between the wiper members. This occurs because of the continued contact between the lower sections of the wiper members and the secondary absorbent member. As a result, the wiper members may be supplied with substantial amounts of cleaning solution even during operation of the cartridge.

In a final embodiment, a thermal inkjet cartridge is used which does not include the primary absorbent member and compartment for retaining the same. This cartridge is used in connection with the service station having dual wiper members as described above. However, in order to supply the capillary pathway between the wiper members with cleaning solution, a reservoir chamber is provided as previous indicated which is operatively secured to the underside of the service station platform. The reservoir chamber has an opening therein, and is filled with a supply of cleaning solution The reservoir chamber is also positioned on the service station platform so that the lower sections of the wiper members come in contact with the cleaning solution in the reservoir chamber through the opening therein. As a result, cleaning solution is drawn out of the reservoir chamber by capillary action into the capillary pathway between the wiper members for delivery to the printhead during cartridge operation. In the alternative, an absorbent member impregnated with the cleaning solution may be positioned within the reservoir chamber, with the lower sections of the wiper members being in direct contact therewith. The absorbent member can be positioned entirely within the reservoir chamber or may extend partially outward therefrom.

The present invention involves a highly efficient system for automatically cleaning the printhead of a thermal inkjet cartridge, and is a substantial advance in the art of printing technology. Accordingly, these and other objects, features, and advantages of the invention will be described below in the following Brief Description of the Drawings and Detailed Description of Preferred Embodiments.

DETAILED DESCRIPTION OF PREFERRED EMBODIMENTS

The present invention involves a unique and highly efficient system for automatically cleaning the printhead of a thermal inkjet cartridge. Specialized components and materials are provided which enable the printhead to be cleaned using a wiper system in combination with the delivery of cleaning solution to the printhead. As a result, cleaning is accomplished in an effective, rapid, and automatic manner.

Figure 1:
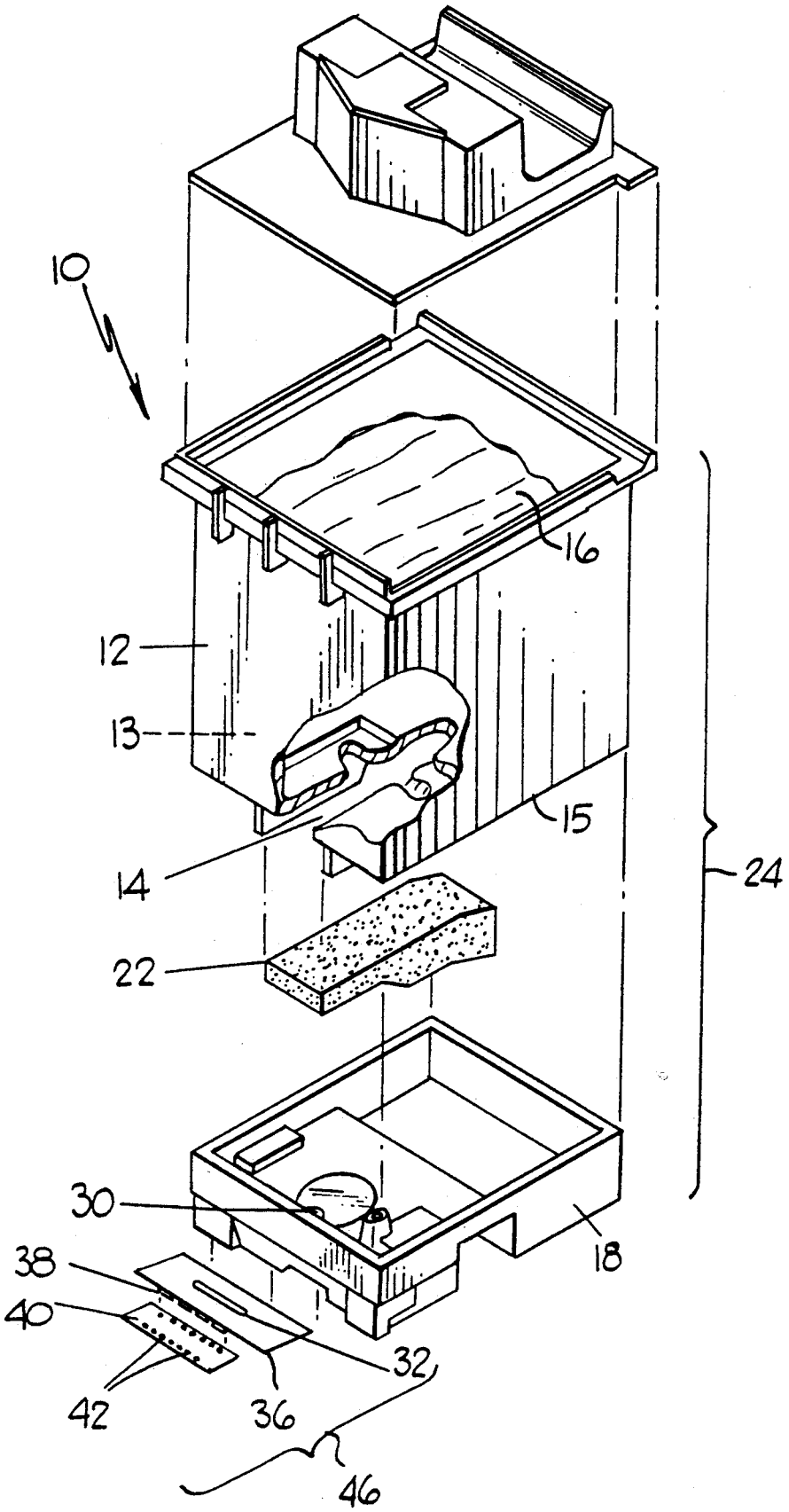
FIG. 1 is an exploded perspective view of a representative thermal inkjet cartridge of conventional design.
Figure 2:
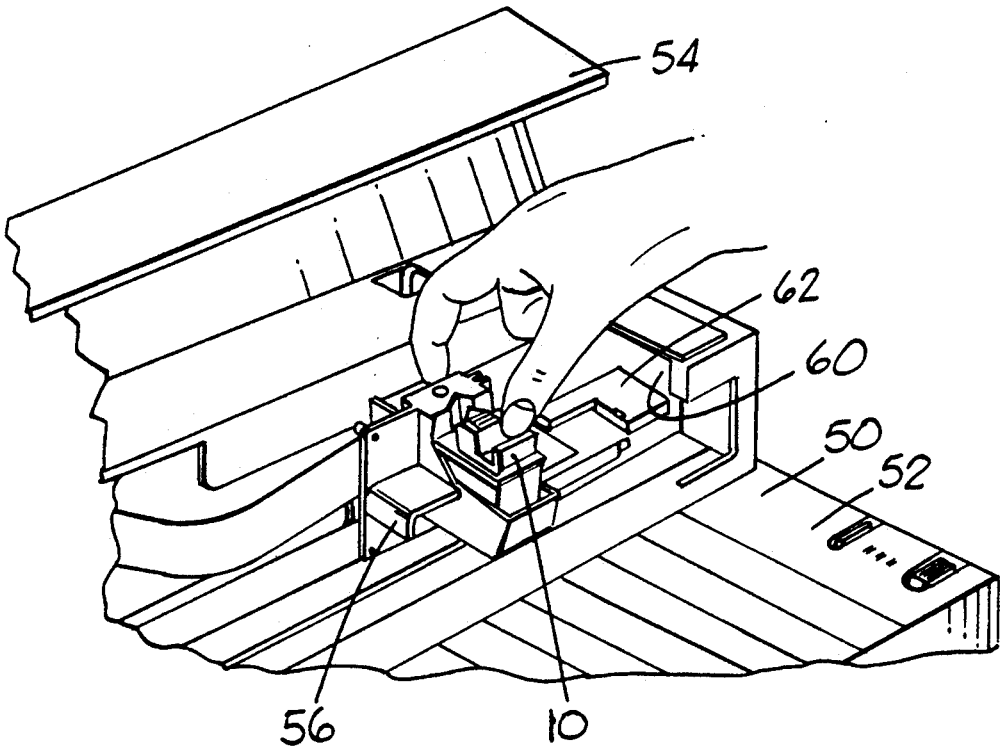
FIG. 2 is a partial perspective view of a representative printer unit of conventional design in which the cartridge of FIG. 1 and cartridges of the present invention may be used.

With reference to FIG. 1, a representative thermal inkjet printing cartridge 10 is illustrated. Cartridge 10 is sold and manufactured by the Hewlett-Packard Co. of Palo Alto, Calif., and is described in U.S. Pat. No. 4,794,409. Cartridge 10 includes a housing 12 which forms a chamber 13 having an opening 14 in the bottom 15 thereof. The chamber 13 is designed to retain a supply 16 of ink therein. Also included is a lower portion 18 sized to receive ink-retaining/storage means in the form of a porous sponge-like member 22. The housing 12 and the lower portion 18 attach together to form a compartment 24 in which the sponge-like member 22 is positioned. Ink from the chamber 13 of the housing 12 flows through the opening 14 into the porous sponge-like member 22. Thereafter, during printer operation, ink flows from the sponge-like member 22 through an outlet 30 in the lower portion 18. The ink then passes through an additional opening 32 in a substrate 36 which includes a plurality of heating resistors 38 thereon (enlarged and schematically illustrated for the sake of clarity in FIG. 1). The cartridge 10 further includes an orifice plate 40 having a plurality of openings 42 which allow the passage of ink therethrough. The orifice plate 40, openings 42, and the substrate 36 with resistors 38 thereon collectively form the printhead 46 of the cartridge 10. In operation, the resistors 38 on the substrate 36 of the printhead 46 are in fluid communication with the supply 16 of ink via the sponge-like member 22. Selective heating of the resistors 38 causes ink coming in contact therewith to be forcefully expelled from the openings 42 in the orifice plate 40, thereby printing desired images. Selective heating of the resistors 38 is accomplished using pulse drive circuitry (not shown) which is either integrated onto the substrate 36 of the printhead 46 as described in U.S. Pat. No. 4,719,477 (incorporated herein by reference), or externally positioned within the main printer unit 50 (FIG. 2). It should be noted that the present invention shall not be limited to applications involving the cartridge 10 illustrated in FIG. 1. The invention is equally applicable to other thermal inkjet printing cartridges. For example, other representative thermal inkjet printing systems are described and illustrated in U.S. Pat. No. 4,500,895 to Buck et al.; the *Hewlett-Packard Journal.* Vol. 36, No. 5 (May 1985), and the *Hewlett-Packard Journal,* Vol. 39, No. 4 (August 1988) all of which are incorporated herein by reference.

The cartridge 10 of FIG. 1 (and cartridges produced in accordance with the present invention) are removably attached to and within a printer unit known in the art. An exemplary printer unit especially suitable for use with the cartridge 10 of FIG. 1 (and the cartridges of the present invention) is shown in FIG. 2 at reference number 50. Printer unit 50 is known in the art and manufactured by the Hewlett-Packard Co. of Palo Alto, Calif. under the "DeskJet" and "DeskWriter" trademarks. Again, the present invention shall not be limited exclusively to the printer unit shown in FIG. 2 and described below. Other comparable printer units known in the art having the features presented herein may also be used.

With continued reference to FIG. 2, printer unit 50 is illustrated. Printer unit 50 includes a housing 52 and a movable cover 54 which may be opened as shown in FIG. 2 to provide access to the operating mechanical components of the unit 50. Such components basically include a carriage unit 56 sized to removably receive cartridge 10 therein. The carriage unit 56 is operatively attached to a drive assembly (not shown) of conventional design which is positioned within the housing 52 of the printer unit 50. The carriage unit 56 and cartridge 10 retained therein are designed for reciprocating movement within the printer unit 50 during the operation thereof. Such reciprocating movement is accomplished using the drive assembly of the printer unit 50.

After the termination of printing and cessation of reciprocating movement, the carriage unit 56 and cartridge 10 are automatically placed in a "parked position" adjacent end 60 of the printer unit 50. In such a position, the cartridge 10 is oriented directly above and in substantial alignment with a service station 62 which is secured to the printer unit 50 at end 60 as illustrated. As previously described, printer service stations are generally known in the art and perform a variety of functions. For example, service stations may be used for (a) priming the printhead; (b) covering the orifice plate and openings therein of the printhead when not in use; (c) wiping contaminants from the orifice plate; (d) preventing ink from drying out in the openings of the orifice plate; and (e) providing a location to eject soft, viscous plugs of ink which may form in the openings of the orifice plate. Specific service stations designed to perform some or all of these functions are disclosed in U.S. Pat. No. 4,853,717 and U.S. Pat. No. 5,027,134 which are incorporated herein by reference.

Figure 3:
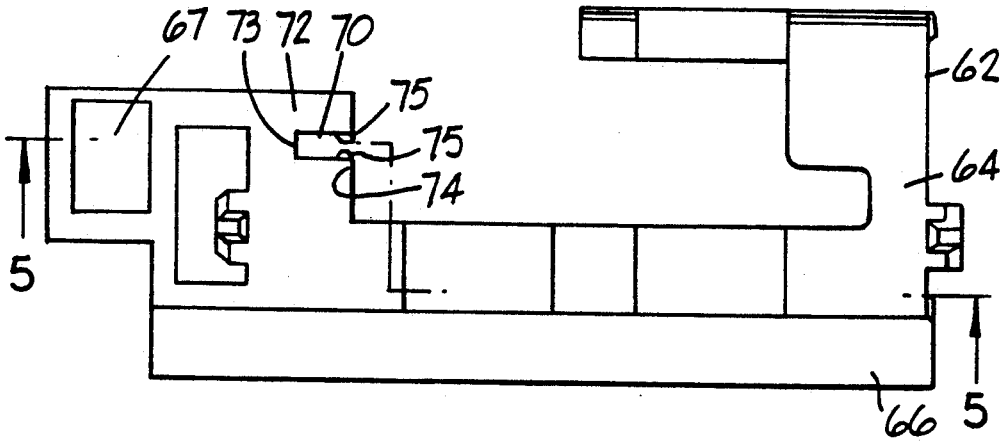
FIG. 3 is a top plan view of a printer service station unit suitable for use in accordance with the present invention.
Figure 4:
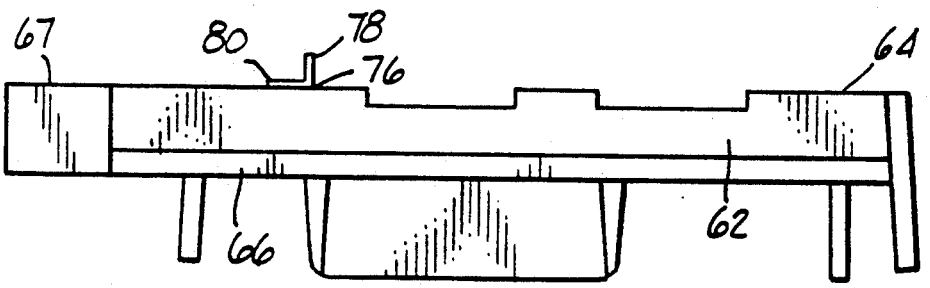
FIG. 4 is a side elevational view of the service station unit of FIG. 3 having a wiper member secured thereto.
Figure 5:
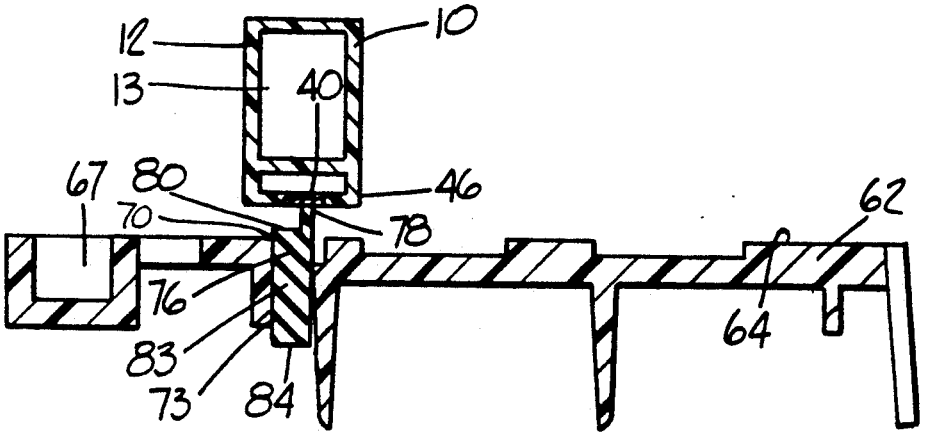
FIG. 5 is a cross sectional view of the service station unit of FIG. 3 taken along line 5—5 thereof having a wiper member secured thereto which is cleaning the printhead of an ink cartridge which is illustrated schematically in cross section.

An exemplary service station 62 is illustrated in FIGS. 3–5. The service station 62 (which is preferably constructed of plastic) includes a platform 64 having an alignment/mounting tab 66 thereon. Also provided is a reservoir-like cavity or spittoon 67 (FIG. 5) which is designed to collect any ink ejected (intentionally or unintentionally) from the cartridge 10 when positioned over the service station 62. With reference to FIG. 3, an inwardly-directed slot 70 is provided at position 72 on the platform 64. The slot 70 has a rear wall 73 shown in FIG. 3. The front portion 74 of the slot 70 includes dual, rounded projection members 75 which extend inwardly into the slot 70 as illustrated. Further information regarding service station 62 is provided in U.S. Pat. No. 4,853,717 which is incorporated herein by reference as noted above.

Figure 6:
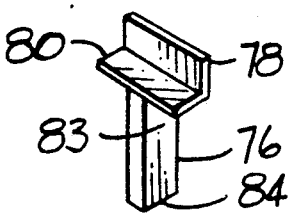
FIG. 6 is a perspective view of a single elongate wiper member suitable for use in accordance with the present invention.

With reference to FIGS. 4–6, a printhead wiper unit in the form of an elongate wiper member 76 is provided. The wiper member 76 (as shown in FIG. 6) is preferably of single-piece construction and made of a resilient, non-abrasive, elastomeric material (e.g. nitrile rubber, ethylene polypropylene diene monomer [EPDM], or other comparable materials known in the art). Wiper member 76 includes an upper section 78 which functions as a blade and extends outwardly from and above the platform 64 when mounted in position as illustrated in FIG. 4. The upper section 78 is preferably at least as wide as the length and/or width of the orifice plate in the cartridge with which it is used so that adequate cleaning of the plate may be accomplished.

The wiper member 76 further includes a laterally projecting horizontal section 80 beneath the upper section 78 which is positioned at about a 90 degree angle relative thereto. In addition, the wiper member 76 includes a medial section 83 and a lower section 84. In a preferred embodiment, the medial section 83 and the lower section 84 are substantially equal in thickness (FIG. 6) and significantly narrower than the upper section 78. When the wiper member 76 is secured to the platform 64, the lower section 84 thereof extends outwardly from and below the platform 64 as illustrated in FIG. 5 and described in greater detail below.

To mount the wiper member 76 in position (FIGS. 4–5), the medial section 83 is urged inwardly into the slot 70 in the platform 64 so that the horizontal section 80 rests on top of the platform 64 as illustrated in FIG. 4. The width of the medial section 83 is greater than the distance between the projection members 75 so that insertion of the medial section 83 between the projection members 75 causes the projection members 75 to frictionally engage the medial section 83 in a secure manner. In the alternative, the wiper member 76 can be secured within the slot 70 using a cyanoacrylate adhesive or other comparable adhesive materials known in the art.

In operation, the upper section 78 of the wiper member 76 is adapted to wipe against the orifice plate 40 of the printhead 46 of cartridge 10 during operation and reciprocating movement thereof as shown schematically in FIG. 5.

It should also be noted that the service station 62 may include a resilient, elastomeric cap member (not shown) mounted on the platform 64 and laterally spaced from the wiper member 76. The cap member is designed to protect and surround the openings 42 in the orifice plate 40 of the cartridge 10 when the cartridge 10 is in a parked position. Further information regarding cap members in general is disclosed in U.S. Pat. Nos. 4,853,717 and 5,027,134 which are again incorporated herein by reference.

Figure 7:
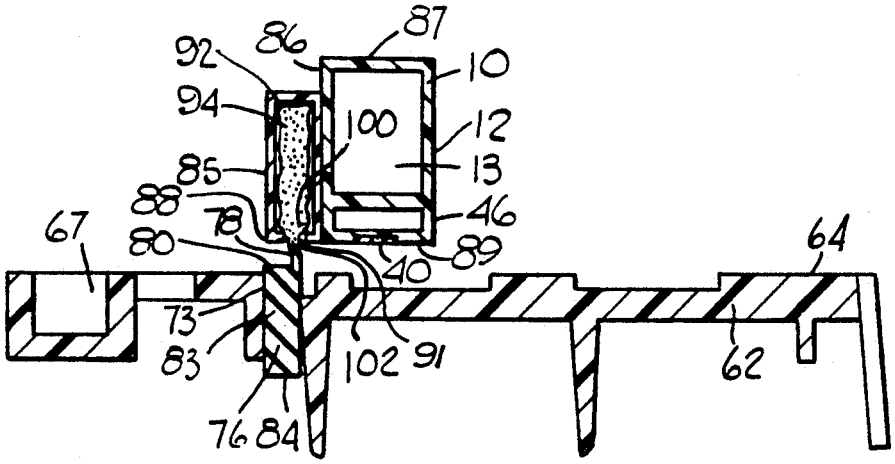
FIG. 7 illustrates the service station of FIG. 5 in association with an ink cartridge schematically shown in cross section which, has been modified in accordance with one embodiment of the present invention.

In order to further enhance the cleaning ability of the wiper member 76, a unique system is provided which enables the delivery of a printhead cleaning solution thereto. With reference to FIG. 7, cartridge 10 is modified to include an internal supply of cleaning solution therein. In the embodiment of FIG. 7, cartridge 10 includes a separate chamber 85 secured to side 86 of the exterior surface 87 of the cartridge housing 12. The chamber 85 may be integrally formed during molding of the housing 12, or may be a separate unit adhesively affixed thereto using a cyanoacrylate adhesive or other comparable adhesive materials known in the art. In the alternative, the chamber 85 may be detachable from the cartridge 10 as desired.

The chamber 85 has a bottom portion 88 which is substantially in alignment with the bottom 89 of the cartridge 10 as illustrated in FIG. 7. The bottom portion 88 of the chamber 85 further includes at least one opening 91 therein. Positioned within the interior 2 of the chamber 85 is a primary absorbent member 94. Using the chamber 85, the primary absorbent member 94 is operatively secured to the cartridge 10 in order to form a single, integrated unit. The primary absorbent member 4 is preferably manufactured of polyurethane foam, cotton, or other absorbent materials known in the art. The primary absorbent member 94 is impregnated with a chemical solution suitable for cleaning the printhead 46 of the cartridge 10. Exemplary cleaning solutions include but are not limited to water, diethylene glycol, a mixture of water and diethylene glycol (50—50 mixture), or a solution corresponding to the vehicle which is used in the supply 16 of ink held by the cartridge 10 (e.g. 2-pyrrolidone, ethylene glycol, diethylene glycol, triethylene glycol, and/or tetraethylene glycol). Glycol solutions are preferred in that they function as "humectants" and absorb moisture from the air. Thus, a primary absorbent member 94 which contains a glycol solution will not readily dry out during extended periods of non-use. However, the present invention shall not be limited to use of the above chemical solutions, and other cleaning agents suitable for the purposes described herein may also be used. Also, should the primary absorbent member 94 be depleted of cleaning solution before the cartridge 10 runs out of ink, the chamber 85 may be manually refilled with cleaning solution by the printer operator through the direct application of cleaning solution to the primary absorbent member 94 via the opening 91.

Figure 8:
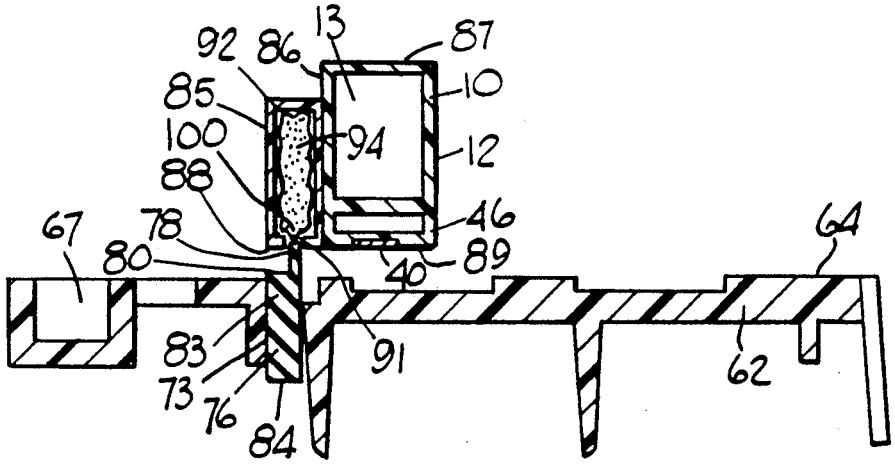
FIG. 8 illustrates the service station of FIG. 5 in association with an ink cartridge schematically shown in cross section which has been modified in accordance with another embodiment of the present invention.

As shown in FIG. 7, the primary absorbent member 94 has a lower section 100, a portion 102 of which is designed to extend slightly outward from the opening 91 in the chamber 85. In an alternative embodiment shown in FIG. 8, the primary absorbent member 94 does not include the portion 102 extending outwardly from the opening 91, and the entire primary absorbent member 94 resides within the interior 92 of the chamber 85 as illustrated. In this embodiment, the opening 91 is sufficiently large to allow passage of the upper section 78 of the wiper member 76 therethrough. In addition, the upper section 78 may be slightly taller in this embodiment to facilitate entry into opening 91.

Figure 9:
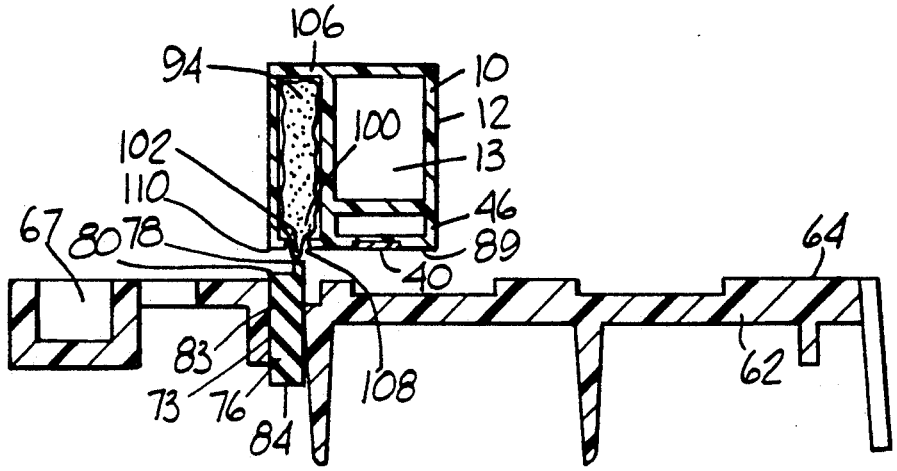
FIG. 9 illustrates the service station of FIG. 5 in association with an ink cartridge schematically shown in cross section which has been modified in accordance with a further embodiment of the present invention.

It should also be noted that the primary absorbent member 94 may be contained within a compartment 106 that is inside of the cartridge housing 12 as shown in FIG. 9. In this embodiment, the cartridge housing 12 may be slightly lengthened to accommodate the compartment 106 which is adjacent to and maintained separately from the ink chamber 13. To accommodate the enlarged housing 12 (should enlargement be necessary), the carriage unit 56 of the printer unit 50 as shown in FIG. 2 may also need to be slightly enlarged. The compartment 106 includes at least one opening 108 at the bottom portion 110 thereof which is designed to provide access to and enable contact with the primary absorbent member 94 therein. As in the embodiment of FIG. 7, the primary absorbent member 94 has a lower section 100, a portion 102 of which is designed to extend slightly outward from the opening 108 in the bottom portion 110 of the compartment 106. However, the portion 102 in this embodiment and in other embodiments of the invention does not extend downwardly enough to come in contact with the wiper units of the invention during reciprocating movement of cartridge 10.

Figure 10:
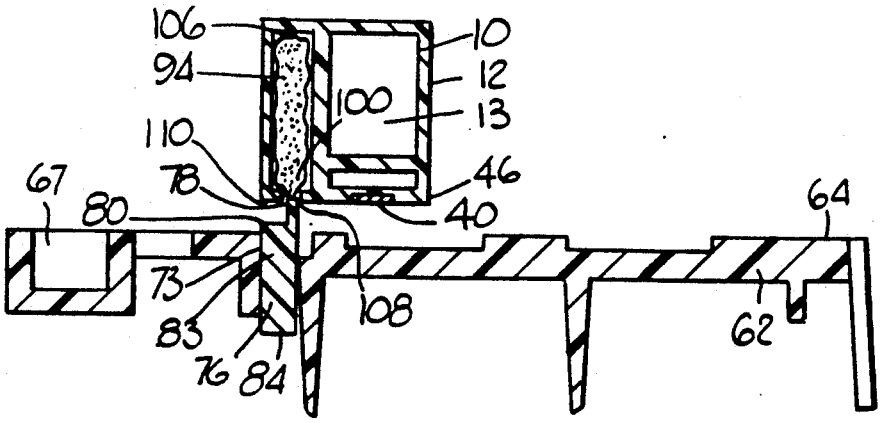
FIG. 10 illustrates the service station of FIG. 5 in association with an ink cartridge schematically shown in cross section which has been modified in accordance with a still further embodiment of the present invention.

In a further alternative embodiment shown in FIG. 10, the primary absorbent member 94 of the compartment 106 does not include the portion 102 extending outwardly from the opening 108, and the entire primary absorbent member 94 resides entirely within the compartment 106 as illustrated. In this embodiment, the opening 108 is sufficiently large to allow passage of the upper section 78 of the wiper member 76 therethrough. In addition, the upper section 78 may again be slightly taller in this embodiment to facilitate entry into opening 108.

Cooperative interaction between the wiper member 76 and the cleaning solution delivery system described herein is illustrated in FIGS. 7–10 relative to the modified cartridges described above. With particular reference to FIG. 7, the cartridge 10 is shown in a parked position, with the movement thereof to such position being controlled by the printer unit 50 in a conventional manner. When in a parked position as illustrated, the chamber 85 of the cartridge 10 is in direct alignment with wiper member 76, and the cartridge 10 is tilted slightly downward by the printer unit 50 in a conventional manner so that the portion 102 of the primary absorbent member 94 is in direct physical contact with the upper section 78 of the wiper member 76. Downward tilting of the cartridge 10 as described above normally occurs in printer units of the type described herein so that the orifice plate 40 may be positioned on a cap member (not shown) which is mounted to the service station platform 64 as previously described. In this configuration, the upper section 78 of the wiper member 76 is moistened with cleaning solution from the primary absorbent member 94. As a result, when the cartridge 10 resumes operation, the moistened wiper member 76 will clean the orifice plate 40 of the printhead 46 with a superior degree of efficiency, especially with respect to dried ink materials thereon. The cooperative arrangement of components described above relative to the embodiment of FIG. 7 applies in an equal manner to the embodiments of FIGS. 8–10. For example, in the embodiment of FIG. 8, the cartridge 10 (when parked) is tilted slightly downward by the printer unit 50 so that the wiper member 76 passes through the opening 91 in the chamber 85 to enable contact with the primary absorbent member 94.

Figure 11:
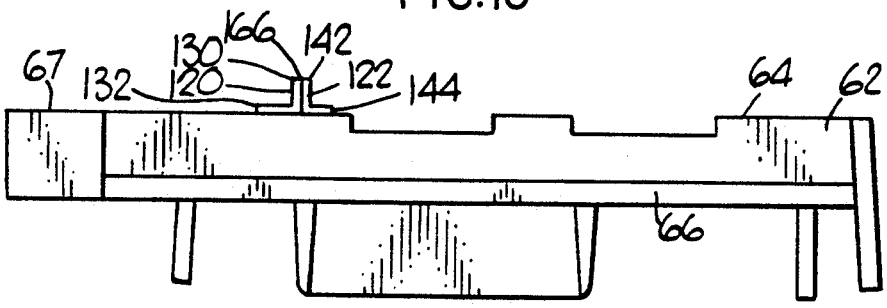
FIG. 11 illustrates an alternative embodiment of a wiper system shown in connection with the service station of FIG. 4.
Figure 12:
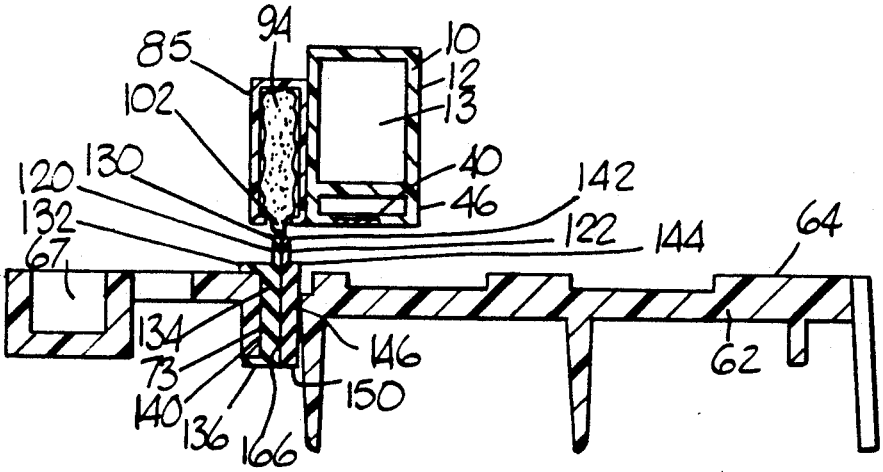
FIG. 12 illustrates the wiper system of FIG. 11 in cross section which is mounted to the service station of FIG. 5 having the schematically-illustrated ink cartridge of FIG. 7 associated therewith.
Figure 13:
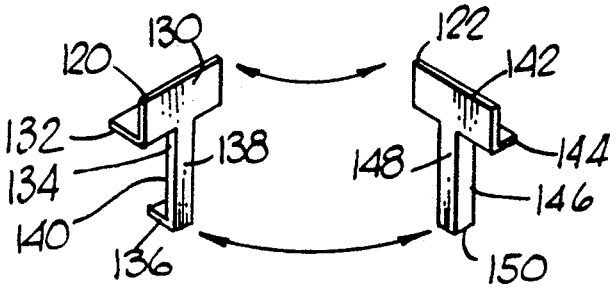
FIG. 13 is a perspective view of the dual wiper members which are used in connection with the wiper system of FIG. 11.

An alternative embodiment of the printhead wiper unit of the present invention is illustrated in FIGS. 11–13. Basically, a dual wiper system is disclosed which includes a first wiper member 120 and a second wiper member 122. Both of the wiper members 120, 122 are manufactured of the same materials described above relative to wiper member 76. In addition, the wiper members 120, 122 are designed to fit within the slot 70 of the service station platform 64 described above.

With reference to FIG. 13, the first wiper member 120 includes an upper section 130 which functions as a blade and extends outwardly from and above the platform 64 when mounted in position as illustrated in FIGS. 11–12. The upper section 130 is at least as wide as the length and/or width of the orifice plate in the cartridge with which it is used so that adequate cleaning of the plate may be accomplished. The first wiper member 120 further includes a laterally projecting horizontal section 132 beneath the upper section 130 which is positioned at about a 90 degree angle relative thereto. In addition, the first wiper member 120 includes a medial section 134 and a lower section 136. In a preferred embodiment, the medial section 134 and the lower section 136 are substantially equal in thickness and significantly narrower than the upper section 130.

When the first wiper member 120 is mounted within the slot 70 of the platform 64, the lower section 136 extends outwardly from and below the platform 64 as illustrated in FIG. 12. With continued reference to FIG. 13, the first wiper member 120 further includes a planar inner face 138. In addition, the medial section 134 includes an open region 140 opposite the planar inner face 138, the function of which will be described below.

The second wiper member 122 also includes an upper section 142 which functions as a blade and extends outwardly from and above the platform 64 when mounted in position as illustrated in FIGS. 11–12. The upper section 142 is of approximately the same width and height as the upper section 130 of the first wiper member 120. The second wiper member 122 further includes a laterally projecting horizontal section 144 beneath the upper section 142 which is positioned at about a 90 degree angle relative thereto. In addition, the second wiper member 122 includes a medial section 146 of substantially the same thickness as the medial section 134 of the first wiper member 120, and a lower section 150. The second wiper member 122 further includes a planar inner face 148 (FIG. 13), the function of which will also be described below. In a preferred embodiment, the medial section 146 and the lower section 150 are substantially equal in thickness and significantly narrower than the upper section 142. When the second wiper member 122 is mounted within the slot 70 of the platform 64, the lower section 150 extends outwardly from and below the platform 64 as illustrated in FIG. 12.

To mount the first wiper member 120 in position, it is positioned within the slot 70 of the platform 64 so that the medial section 134 passes therethrough. The first wiper member 120 is then urged inwardly until the rear wall 73 of the slot 70 (FIG. 12) is positioned within the open region 140 of the medial section 134. In this orientation, the horizontal section 132 is positioned on top of the platform 64 as illustrated. The first wiper member 120 is retained in position by the frictional engagement thereof with the walls of the slot 70 or through the use of a cyanoacrylate adhesive or other comparable adhesive materials known in the art.

To mount the second wiper member 122 in position, the medial section 146 thereof is urged inwardly into the slot 70 in the platform 64 so that the horizontal section 144 rests on the platform 64 as illustrated in FIG. 11. The width of the medial section 146 is greater than the distance between the projection members 75 in the slot 70 so that insertion of the medial section 146 between the projection members 75 (FIG. 3) causes the projection members 75 to frictionally engage the medial section 146 in a secure manner. In the alternative, the second wiper member 122 can be secured within the slot 70 using a cyanoacrylate adhesive or other comparable adhesive materials known in the art.

Once the first wiper member 120 and the second wiper member 122 are mounted in place as described above and illustrated in FIGS. 11–12, the inner face 138 of the first wiper member 120 and the inner face 148 of the second wiper member 122 will be positioned adjacent to and directly against each other within the slot 70 in an abutting relationship so as to form a capillary pathway 166 therebetween (FIGS. 11 and 12). Notwithstanding the abutting relationship between the inner faces 138, 148 of the first wiper member 120 and the second wiper member 122, liquid cleaning solution is still capable of being drawn into and through the capillary pathway 166 by complex physical capillary forces not yet fully understood. However, it is contemplated that liquid cleaning solution is drawn into the capillary pathway 166 due to a strong surface attraction exerted by the inner faces 138, 148 relative to the cleaning solution.

With continued reference to FIG. 12, the benefits provided by the first and second wiper members 120, 122 and capillary pathway 166 will be readily apparent. Specifically, when the cartridge 10 is in a parked position as illustrated (and described above relative to the embodiments of FIGS. 7–10), the chamber 85 of the cartridge 10 is in alignment with the first and second wiper members 120, 122. In this orientation, the cartridge 10 is tilted slightly downward as previously discussed so that the portion 102 of the primary absorbent member 94 is in direct physical contact with the upper sections 130, 142 of the first and second wiper members 120, 122 and the capillary pathway 166 therebetween. As a result, cleaning solution from the primary absorbent member 94 is drawn into the capillary pathway 166 by capillary action forces exerted against the cleaning solution in the primary absorbent member 94. This enables a supply of cleaning solution to be retained between the inner faces 138, 148 of the first and second wiper members 120, 122. Accordingly, when the cartridge 10 resumes operation within the printer unit 50, contact between the orifice plate 40 of cartridge 10 and the upper sections 130, 142 of the first and second wiper members 120, 122 causes cleaning solution held within the capillary pathway 166 to be drawn outwardly therefrom and applied to the orifice plate 40. This most likely occurs through hydrostatic attraction between the cleaning solution and the orifice plate 40 which is stronger than the capillary forces which retain the cleaning solution within the capillary pathway 166. Thus, the components described above including the first and second wiper members 120, 122 and capillary pathway 166 therebetween cooperate effectively with the other components of the invention to greatly facilitate cleaning of the orifice plate 40 of the printhead 46 of cartridge 10. While the embodiment of FIG. 12 is shown in connection with the cartridge of FIG. 7, the other cartridge embodiments shown and described herein may also be used in a similar manner relative to the system of FIG. 12.

Figure 14:
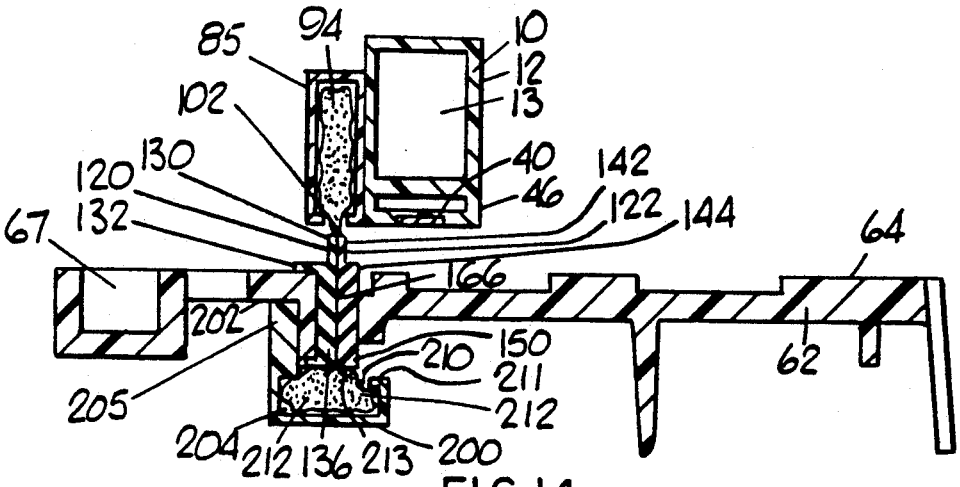
FIG. 14 illustrates the service station of FIG. 5 and the schematically illustrated ink cartridge of FIG. 7 in association with a still further embodiment of the invention involving the use of a separate reservoir chamber schematically illustrated in cross section and mounted beneath the service station.

A still further optional embodiment of the invention is illustrated in FIG. 14. Specifically, the service station platform 64 is adapted to include a reservoir chamber 200 attached to the underside 202 thereof. The reservoir chamber 200 may be box-like or rectangular in configuration. The reservoir chamber 200 preferably includes an interior region 204 and mounting post 205 which is adhesively affixed to the underside 202 of the platform using a cyanoacrylate adhesive or other comparable adhesive materials known in the art. In addition, the reservoir chamber 200 includes an opening 210 in the top 211 thereof in order to provide access to the interior region 204. In a preferred embodiment, the interior region 204 is sized to receive a secondary absorbent member 212 made of the same materials used to construct the primary absorbent member 94. With reference to FIG. 14, the secondary absorbent member 212 includes a portion 213 thereof which extends outwardly from the reservoir chamber 200 through the opening 210 thereof. The portion 213 is positioned so that it comes in direct physical contact with the lower sections 136, 150 of the first wiper member 120 and the second wiper member 122. Likewise, in this configuration, the capillary pathway 166 is in direct physical contact with the secondary absorbent member 212.

In an even further alternative embodiment (FIG. 15), the secondary absorbent member 212 does not include the outwardly extending portion 213, with the secondary absorbent member 212 being positioned entirely within the interior region 204 of the reservoir chamber 200. In this embodiment, the reservoir chamber 200 may be positioned slightly closer to the first wiper member 120 and the second wiper member 122 so that the lower sections 136, 150 of the first wiper member 120 and the second wiper member 122 pass through the opening 210 and extend into the interior region 204 of the reservoir chamber 200. To accomplish this, the opening 210 is sufficiently sized to allow the passage of the lower sections 136, 150 of the wiper members 120, 122 therethrough. As a result, the lower sections 136, 150 and capillary pathway 166 come in direct physical contact with the secondary absorbent member 212 inside of the reservoir chamber 200.

The reservoir chamber 200 and secondary absorbent member 212 may serve a variety of useful purposes. For example, in the embodiments of FIGS. 14–15, cleaning solution from the primary absorbent member 94 can pass into the capillary pathway 166 between the first and second wiper members 120, 122, with the cleaning solution thereafter being drawn from the capillary pathway 166 into the secondary absorbent member 212. As a result, excess cleaning solution may be withdrawn from the capillary pathway 166 and retained within the secondary absorbent member 212. When the cartridge 10 resumes operation and the first and second wiper members 120, 122 are taken out of contact with the primary absorbent member 94, the full effect of the capillary forces exerted by the capillary pathway 166 may then be exerted on the secondary absorbent member 212. This enables cleaning solution to be withdrawn from the secondary absorbent member 212 and pulled back into the capillary pathway 166. More specifically, the capillary forces exerted by the capillary pathway 166 (when not in contact with the primary absorbent member 94) are significantly higher than the absorptive forces exerted by the secondary absorbent member 212 on the cleaning solution held therein. Ultimately, this enables a supply of cleaning solution to be withdrawn from the secondary absorbent member 212 during cartridge operation and effectively delivered to the upper sections 130, 142 of the first and second wiper members 120, 122. Accordingly, with each pass of the cartridge 10, fresh cleaning solution is therefore made available. This is especially important when the cartridge 10 is operating for long periods of time without entering into a parked position.

Furthermore, use of the reservoir chamber 200 and secondary absorbent member 212 as described herein may also enable printhead cleaning to occur without the use of a cartridge having its own supply of cleaning solution therein as described above. Instead, cleaning solution would be supplied entirely by the secondary absorbent member 212 within the reservoir chamber 200. In this embodiment, the secondary absorbent member 212 could be manually supplied with fresh cleaning solution at periodic intervals by the printer operator. In order to accomplish this, the reservoir chamber could be removably detachable from the service station platform 64 (instead of being adhesively affixed thereto) so that cleaning solution could be applied to the secondary absorbent member 212 through the opening 210.

Figure 15:
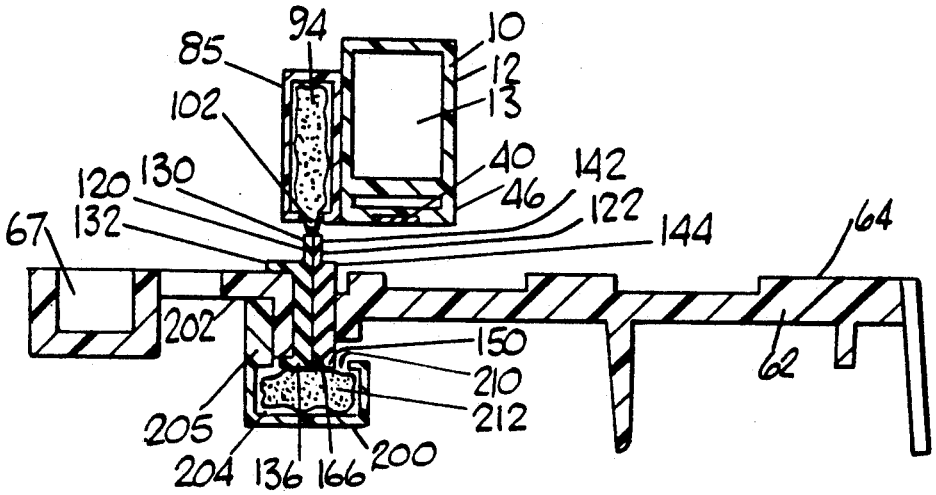
FIG. 15 illustrates the service station of FIG. 5 and the schematically illustrated ink cartridge of FIG. 7 in association with an alternative embodiment of the reservoir chamber of FIG. 14.
Figure 16:
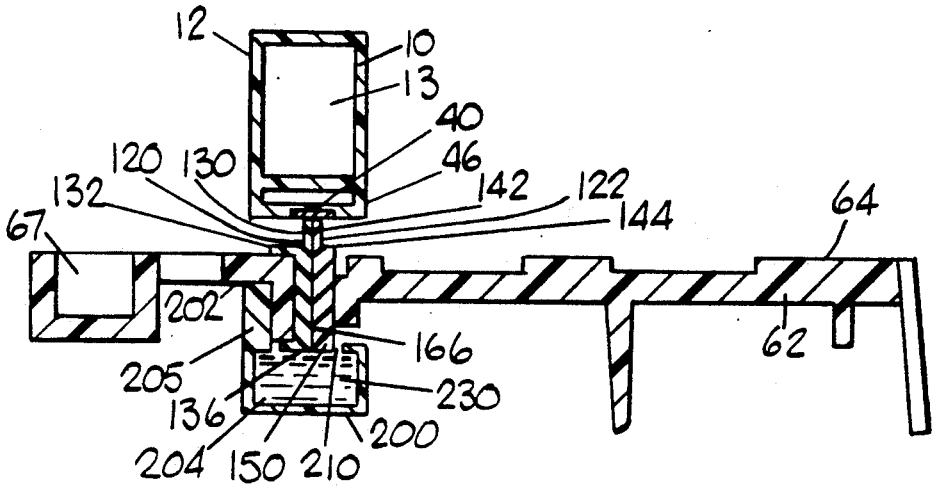
FIG. 16 illustrates the service station of FIG. 5 and the schematically illustrated ink cartridge of FIG. 5 in association with an even further embodiment of the reservoir chamber of FIG. 14.

A final embodiment of the assembly shown in FIGS. 14–15 is illustrated in FIG. 16. Basically, the components are the same as those illustrated in FIG. 15, with the lower sections 136, 150 of the first and second wiper members 120, 122 being positioned within the interior region 204 of the reservoir chamber 200 through the opening 210 therethrough. However, the reservoir chamber 200 would not include the secondary absorbent member 212, but would instead simply include a supply 230 of liquid cleaning solution therein into which the lower sections 136, 150 and capillary pathway 166 would be immersed as illustrated. The supply 230 of cleaning solution would then be drawn upwardly into the capillary pathway 166 by capillary action for distribution to the printhead 46 of the cartridge 10 as described above. The supply 230 of cleaning solution could be replenished in the same manner described above relative to the embodiments of FIGS. 14–15, with the reservoir chamber 200 being detachable as indicated above. This embodiment is especially suitable for use in a printing system in which cartridges are provided which do not include self-contained supplies of cleaning solution as indicated herein.

The present invention as described above provides numerous and substantial benefits, including rapid and efficient cleaning of the printhead components of a thermal inkjet cartridge. The invention enables the printhead to be wiped and supplied with cleaning solution simultaneously in an entirely automatic manner. Accordingly, the invention represents a substantial advance in the art of thermal inkjet printing technology.

Having herein described preferred embodiments of the present invention, it is anticipated that suitable modifications may be made thereto by individuals skilled in the art to which the invention pertains. For example, the exact configuration, size, and shape of the structural components described herein may be varied while still falling within the scope of the invention. This also applies to the types of cleaning solution and absorbent members described herein. Thus, the present invention shall only be construed in accordance with the following claims:

We claim:

1. A self-cleaning thermal inkjet printing system for use in a thermal inkjet printer unit comprising:

an ink cartridge detachably mounted to and movably positioned within said thermal inkjet printer unit, said cartridge comprising a housing having a supply of ink therein and a printhead in fluid communication with said ink, said printhead comprising a plurality of resistors and an outer plate having a plurality of openings therethrough, said ink being expelled from said openings through said plate by heat generated from said resistors during operation of said cartridge, said cartridge further comprising a primary absorbent member impregnated with a supply of a printhead cleaning solution; and a service station mounted to said printer unit, said cartridge being oriented in a parked position directly above said service station when said cartridge is not in operation, said service station comprising a platform having at least one resilient, elongate printhead wiper secured thereto, said wiper coming in direct contact with said printhead during movement of said cartridge in order to clean said printhead, said wiper being secured to said platform at a position thereon so that when said cartridge is in said parked position said wiper is aligned with said primary absorbent member and in direct contact therewith in order to receive said cleaning solution therefrom, said wiper thereafter being moistened with said cleaning solution in order to facilitate cleaning of said printhead during operation of said cartridge.

2. The printing system of claim 1 wherein said cartridge further comprises a compartment having said primary absorbent member therein, said compartment comprising at least one opening therethrough in order to provide access to and enable direct contact with said primary absorbent member within said compartment.

3. The printing system of claim 2 wherein at least a portion of said primary absorbent member within said compartment extends outwardly from said opening and beneath said compartment in order to facilitate direct contact between said wiper and said primary absorbent member.

4. The printing system of claim 2 wherein said housing of said cartridge comprises an exterior surface, and said compartment of said cartridge having said primary absorbent member therein comprises a separate storage chamber mounted to said exterior surface.

5. The printing system of claim 2 wherein said compartment of said cartridge having said primary absorbent member therein is positioned inside of said housing of said cartridge, said housing of said cartridge further comprising an ink chamber therein, said supply of ink being retained within said ink chamber, said ink chamber being maintained separately from said compartment having said primary absorbent member therein.

6. The printing system of claim 1 wherein said resilient, elongate printhead wiper comprises a plurality of wiper members operatively secured to said platform of said service station, said wiper members comprising a first wiper member secured to said platform and a second wiper member secured to said platform, said first wiper member being positioned adjacent to and directly against said second wiper member in order to form a capillary pathway therebetween, said capillary pathway receiving said cleaning solution from said primary absorbent member when said cartridge is in said parked position.

7. The printing system of claim 6 wherein said first wiper member comprises an upper section and a lower section, and said second wiper member comprises an upper section and a lower section, said upper section of said first wiper member and said upper section of said second wiper member each extending outwardly from and above said platform and coming in direct contact with said primary absorbent member when said cartridge is in said parked position, said lower section of said first wiper member and said lower section of said second wiper member each extending outwardly from and below said platform.

8. The printing system of claim 7 wherein said platform of said service station further comprises a secondary absorbent member operatively secured thereto, said secondary absorbent member being in direct contact with said lower section of said first wiper member and said lower section of said second wiper member.

9. The printing system of claim 8 wherein said platform of said service station further comprises a reservoir chamber operatively attached thereto, said reservoir chamber comprising an interior region and an opening therethrough, said secondary absorbent member being positioned within said interior region of said reservoir chamber.

10. A self-cleaning thermal inkjet printing system for use in a thermal inkjet printing unit comprising:

an ink cartridge detachably mounted to and movably positioned within said thermal inkjet printer unit, said cartridge comprising a housing having an exterior surface, a supply of ink within said housing, and a printhead in fluid communication with said ink, said printhead comprising a plurality of resistors and an outer plate having a plurality of openings therethrough, said ink being expelled from said openings through said plate by heat generated from said resistors during operation of said cartridge, said cartridge further comprising a storage chamber mounted to said exterior surface of said housing, said storage chamber comprising a primary absorbent member therein, said primary absorbent member being impregnated with a supply of a printhead cleaning solution, said storage chamber further comprising at least one opening therethrough in order to provide access to and enable direct contact with said primary absorbent member; and a service station mounted to said printer unit, said cartridge being oriented in a parked position directly above said service station when said cartridge is not in operation, said service station comprising a platform having a plurality of resilient, elongate wiper members secured thereto, said wiper members comprising a first wiper member and a second wiper member, said first wiper member being positioned adjacent to and directly against said second wiper member in order to form a capillary pathway therebetween, said wiper members coming in direct contact with said printhead during movement of said cartridge in order to clean said printhead, said wiper members being secured to said platform at a position thereon so that when said cartridge is in said parked position said wiper members are aligned with said storage chamber of said cartridge and in direct contact with said primary absorbent member through said opening in said storage chamber in order to receive said cleaning solution therefrom, said cleaning solution being received and retained within said capillary pathway between said first wiper member and said second wiper member.

11. The printing system of claim 10 wherein at least a portion of said primary absorbent member within said storage chamber extends outwardly from said opening and beneath said storage chamber in order to facilitate direct contact between said wiper members and said primary absorbent member.

12. The printing system of claim 10 wherein said first wiper member comprises an upper section and a lower section, and said second wiper member comprises an upper section and a lower section, said upper section of said first wiper member and said upper section of said second wiper member each extending outwardly from and above said platform and coming in direct contact with said primary absorbent member when said cartridge is in said parked position, said lower section of said first wiper member and said lower section of said second wiper member each extending outwardly from and below said platform.

13. The printing system of claim 12 wherein said platform of said service station further comprises a secondary absorbent member operatively secured thereto, said secondary absorbent member being in direct contact with said lower section of said first wiper member and said lower section of said second wiper member.

14. The printing system of claim 13 wherein said platform of said service station further comprises a reservoir chamber operatively attached thereto, said reservoir chamber comprising an interior region and an opening therethrough, said secondary absorbent member being positioned within said interior region of said reservoir chamber.

15. A self-cleaning thermal inkjet printing system for use in a thermal inkjet printer unit comprising:

an ink cartridge detachably mounted to and movably positioned within said thermal inkjet printer unit, said cartridge comprising a housing having a supply of ink therein and a printhead in fluid communication with said ink, said printhead comprising a plurality of resistors and an outer plate having a plurality of openings therethrough, said ink being expelled from said openings through said plate by heat generated from said resistors during operation of said cartridge, said cartridge further comprising a compartment having a primary absorbent member therein impregnated with a supply of a printhead cleaning solution, said compartment being positioned inside of said housing of said cartridge and comprising at least one opening therethrough in order to provide access to and enable direct contact with said primary absorbent member, said housing of said cartridge further comprising an ink chamber therein, said supply of ink being retained within said ink chamber, said ink chamber being maintained separately from said compartment having said primary absorbent member therein; and a service station mounted to said printer unit, said cartridge being oriented in a parked position directly above said service station when said cartridge is not in operation, said service station comprising a platform having a plurality of resilient, elongate wiper members secured thereto, said wiper members comprising a first wiper member and a second wiper member, said first wiper member being positioned adjacent to and directly against said second wiper member in order to form a capillary pathway therebetween, said wiper members coming in direct contact with said printhead during movement of said cartridge in order to clean said printhead, said wiper members being secured to said platform at a position thereon so that when said cartridge is in said parked position said wiper members are aligned with said compartment of said cartridge and in direct contact with said primary absorbent member through said opening in said compartment in order to receive said cleaning solution therefrom, said cleaning solution being received and retained within said capillary pathway between said first wiper member and said second wiper member.

16. The printing system of claim 15 wherein at least a portion of said primary absorbent member within said compartment extends outwardly from said opening and beneath said compartment in order to facilitate direct contact between said wiper members and said primary absorbent member.

17. The printing system of claim 15 wherein said first wiper member comprises an upper section and a lower section, and said second wiper member comprises an upper section and a lower section, said upper section of said first wiper member and said upper section of said second wiper member each extending outwardly from and above said platform and coming in direct contact with said primary absorbent member when said cartridge is in said parked position, said lower section of said first wiper member and said lower section of said second wiper member each extending outwardly from and below said platform.

18. The printing system of claim 17 wherein said platform of said service station further comprises a secondary absorbent member operatively secured thereto, said secondary absorbent member being in direct contact with said lower section of said first wiper member and said lower section of said second wiper member.

19. The printing system of claim 18 wherein said platform of said service station further comprises a reservoir chamber operatively attached thereto, said reservoir chamber comprising an interior region and an opening therethrough, said secondary absorbent member being positioned within said interior region of said reservoir chamber.

20. A self-cleaning thermal inkjet printing system for use in a thermal inkjet printing unit comprising:

an ink cartridge detachably mounted to and movably positioned within said thermal inkjet printer unit, said cartridge comprising a housing a supply of ink therein and a printhead in fluid communication with said ink, said printhead comprising a plurality of resistors and an outer plate having a plurality of openings therethrough, said ink being expelled from said openings through said plate by heat generated from said resistors during operation of said cartridge; and a service station mounted to said printer unit, said cartridge being oriented in a parked position directly above said service station when said cartridge is not in operation, said service station comprising a platform having a plurality of resilient, elongate wiper members secured thereto, said wiper members comprising a first wiper member and a second wiper member, said first wiper member being positioned adjacent to and directly against said second wiper member in order to form a capillary pathway therebetween, said wiper members coming in direct contact with said printhead during movement of said cartridge in order to clean said printhead, said service station further comprising a reservoir chamber operatively attached to said platform, said reservoir chamber comprising an interior region having a supply of a printhead cleaning solution therein and an opening therethrough in order to provide access to said interior region, said lower section or said first wiper member and said lower section of said second wiper member coming in direct contact with said cleaning solution in said reservoir chamber through said opening, said cleaning solution being received and retained within said capillary pathway between said first wiper member and said second wiper member.

21. A self-cleaning thermal inkjet printing system for use in a thermal inkjet printer unit, said cartridge comprising a housing having a supply of ink therein and a printhead in fluid communication with said ink, said printhead comprising a plurality of resistors and an outer plate having a plurality of openings therethrough, said ink being expelled from said openings through said plate by heat generated from said resistors during operation of said cartridge; and a service station mounted to said printer unit, said cartridge being oriented in a parked position directly above said service station when said cartridge is not in operation, said service station comprising a platform having a plurality of resilient, elongate wiper members secured thereto, said wiper members comprising a first wiper member and a second wiper member, said first wiper member being positioned adjacent to and directly against said second wiper member in order to form a capillary pathway therebetween, said first wiper member comprising an upper section and a lower section, and said second wiper member comprising an upper section and a lower section, said upper section of said first wiper member and said upper section of said second wiper member coming in direct contact with said printhead during movement of said cartridge in order to clean said printhead, said platform of said service station further comprising an absorbent member operatively secured thereto, said absorbent member being in direct contact with said lower section of said first wiper member and said lower section of said second wiper member.

22. The printing system of claim 21 wherein said platform of said service station further comprises a reservoir chamber operatively attached thereto, said reservoir chamber comprising an interior region and an opening therethrough, said absorbent member being positioned within said interior region of said reservoir chamber.

23. A method for cleaning an ink cartridge printhead in a thermal inkjet printer unit comprising the steps of:

providing an ink cartridge comprising a housing having a supply of ink therein and a printhead in fluid communication with said ink, said printhead comprising a plurality of resistors and an outer plate having a plurality of openings therethrough, said ink being expelled from said openings through said plate by heat generated from said resistors during operation of said cartridge, said cartridge further comprising a primary absorbent member impregnated with a supply of a printhead cleaning solution;

positioning said cartridge within said printer unit, said printer unit comprising a service station mounted thereto, said service station comprising a platform having at least one resilient, elongate printhead wiper secured thereto;

activating said printer unit in order to cause reciprocating movement of said cartridge, said wiper coming in direct contact with said printhead during said reciprocating movement of said cartridge in order to clean said printhead;

terminating said reciprocating movement of said cartridge;

moving said cartridge to a stationary, parked position within said printer unit after said terminating of said reciprocating movement; and positioning said wiper directly against said primary absorbent member in order to moisten said wiper with said cleaning solution while said cartridge is in said parked position.

24. A method for cleaning an ink cartridge printhead in a thermal inkjet printer unit comprising the steps of:

providing an ink cartridge comprising a housing having a supply of ink therein and a printhead in fluid communication with said ink, said printhead comprising a plurality of resistors and an outer plate having a plurality of openings therethrough, said ink being expelled from said openings through said plate by heat generated from said resistors during operation of said cartridge, said cartridge further comprising a primary absorbent member impregnated with a supply of a printhead cleaning solution;

positioning said cartridge within said printer unit, said printer unit comprising a service station mounted thereto, said service station comprising a platform having a plurality of resilient, elongate wiper members secured thereto, said wiper members comprising a first wiper member and a second wiper member, said first wiper member being positioned adjacent to and directly against said second wiper member in order to form a capillary pathway therebetween, said first wiper member comprising an upper section and a lower section, and said second wiper member comprising an upper section and a lower section;

activating said printer unit in order to cause reciprocating movement of said cartridge, said wiper members coming in direct contact with said printhead during said reciprocating movement of said cartridge in order to clean said printhead;

terminating said reciprocating movement of said cartridge;

moving said cartridge to a stationary, parked position within said printer unit after said terminating of said reciprocating movement; and positioning said upper section of said first wiper member and said upper section of said second wiper member directly against said primary absorbent member so that said cleaning solution therefrom is received and retained within said capillary pathway between said first wiper member and said second wiper member while said cartridge is in said parked position.

25. The method of claim 24 wherein said platform of said service station further comprises a secondary absorbent member operatively secured thereto, said secondary absorbent member being in direct contact with said lower section of said first wiper member and said lower section of said second wiper member, said method further comprising the step of allowing said cleaning solution within said capillary pathway between said first wiper member and said second wiper member to flow downwardly and outwardly therefrom into said secondary absorbent member.

26. A method for cleaning an ink cartridge printhead in a thermal inkjet printer unit comprising the steps of:

providing an ink cartridge comprising a housing having a supply of ink therein and a printhead in fluid communication with said ink, said printhead comprising a plurality of resistors and an outer plate having a plurality of openings therethrough, said ink being expelled from said openings through said plate by heat generated from said resistors during operation of said cartridge;

positioning said cartridge within said printer unit, said printer unit comprising a service station mounted thereto, said service station comprising a platform having a plurality of resilient, elongate wiper members secured thereto, said wiper members comprising a first wiper member and a second wiper member, said first wiper member being positioned adjacent to and directly against said second wiper member in order to form a capillary pathway therebetween, said first wiper member comprising an upper section and a lower section, and said second wiper member comprising an upper section and a lower section, said service station further comprising a reservoir chamber operatively attached to said platform, said reservoir chamber comprising an interior region having a supply of a printhead cleaning solution therein and an opening through said reservoir chamber in order to provide access to said interior region thereof, said lower section of said first wiper member and said lower section of said second wiper member coming in direct contact with said printhead cleaning solution in said reservoir chamber through said opening;

activating said printer unit in order to cause reciprocating movement of said cartridge, said wiper members coming in direct contact with said printhead during said reciprocating movement of said cartridge in order to clean said printhead; and withdrawing said printhead cleaning solution from said reservoir chamber into said capillary pathway between said wiper members, said cleaning solution thereafter being moved upwardly through said capillary pathway by capillary action so that said cleaning solution may be delivered to said printhead when said wiper members come in direct contact with said printhead during said reciprocating movement of said cartridge.

27. The method of claim 26 wherein said reservoir chamber further comprises an absorbent member within said interior region thereof, said absorbent member being impregnated with said cleaning solution and coming in direct contact with said lower section of said first wiper member and said lower section of said second wiper member.

28. A wiper assembly for use in a self-cleaning thermal inkjet printing system comprising:

a support platform;

a resilient, elongate first wiper member operatively secured to said support platform, said first wiper member comprising an upper section, said upper section extending outwardly from and above said platform, said first wiper member further comprising a planar inner face; and a resilient, elongate second wiper member, said second wiper member being entirely separate from said first wiper member and comprising an upper section and a planar inner face, said upper section extending outwardly from and above said platform, said second wiper member being operatively secured to said platform at a position thereon so that said planar inner face of said first wiper member and said planar inner face of said second wiper member are adjacent to and directly against each other in order to form a capillary pathway therebetween, said capillary pathway being at least as long as said first wiper member and said second wiper member.

29. A wiper assembly for use in a self-cleaning thermal inkjet printing system comprising:

a support platform;

a resilient, elongate first wiper member operatively secured to said platform, said first wiper member having an upper section and a lower section, said upper section extending outwardly from and above said platform, and said lower section of said first wiper member extending outwardly from and below said platform;

a resilient, elongate second wiper member operatively secured to said platform at a position adjacent to and directly against said first wiper member in order to form a capillary pathway therebetween, said second wiper member having an upper section and a lower section, said upper section of said second wiper member extending outwardly from and above said platform, and said lower section of said second wiper member extending outwardly from and below said platform; and a reservoir chamber operatively attached to said support platform, said reservoir chamber comprising an interior region and an opening therethrough, said reservoir chamber further comprising a supply of a printhead cleaning solution within said interior region, said lower section of said first wiper member and said lower section of said second wiper member coming in direct contact with said cleaning solution within said interior region of said reservoir chamber through said opening therethrough.

30. The wiper assembly of claim 29 wherein said interior region of said reservoir chamber further comprises an absorbent member therein, said absorbent member being impregnated with said supply of said printhead cleaning solution, said absorbent member being in direct contact with said lower section of said first wiper member and said lower section of said second wiper member.

* * * * *